US009805610B2

(12) United States Patent
Conner et al.

(10) Patent No.: US 9,805,610 B2
(45) Date of Patent: Oct. 31, 2017

(54) PASSIVE AIRCRAFT WINGTIP STRIKE DETECTION SYSTEM AND METHOD

(71) Applicants: Kevin J Conner, Kent, WA (US); Yasuo Ishihara, Kirkland, WA (US)

(72) Inventors: Kevin J Conner, Kent, WA (US); Yasuo Ishihara, Kirkland, WA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 120 days.

(21) Appl. No.: 14/561,920

(22) Filed: Dec. 5, 2014

(65) Prior Publication Data

US 2015/0325131 A1 Nov. 12, 2015

Related U.S. Application Data

(60) Provisional application No. 61/989,341, filed on May 6, 2014.

(51) Int. Cl.

| | |
|---|---|
| ***G08G 5/04*** | (2006.01) |
| ***G08G 1/16*** | (2006.01) |
| ***G08G 5/00*** | (2006.01) |
| ***G08G 5/06*** | (2006.01) |

(52) U.S. Cl.
CPC ..... *G08G 5/04* (2013.01); *G08G 5/0021* (2013.01); *G08G 5/065* (2013.01)

(58) Field of Classification Search
None
See application file for complete search history.

(56) References Cited

U.S. PATENT DOCUMENTS

| | | | | |
|---|---|---|---|---|
| 6,618,047 | B1 * | 9/2003 | Lim | 345/421 |
| 2007/0067093 | A1 | 3/2007 | Pepitone | |
| 2007/0078591 | A1 * | 4/2007 | Meunier | G05D 1/0083 701/120 |
| 2007/0276553 | A1 | 11/2007 | Bitar et al. | |
| 2010/0017127 | A1 | 1/2010 | Pepitone et al. | |
| 2010/0023264 | A1 | 1/2010 | G. | |

(Continued)

OTHER PUBLICATIONS

Extended EP Search Report for Application No. 15164349.1-1810 dated Sep. 9, 2015.

(Continued)

*Primary Examiner* — Khoi Tran
*Assistant Examiner* — Paul Castro
(74) *Attorney, Agent, or Firm* — Lorenz & Kopf, LLP

(57) ABSTRACT

A system and method for passively detecting aircraft wingtip strikes includes generating a digital base map represented by a plurality of aerodrome cells. A numeric value representative of the specific wingtip is assigned to each of the aerodrome cells. An index count array is generated that has a separate entry for each numeric value. A digital aircraft structure representative of an aircraft is generated, and is represented by a plurality of aircraft cells. A determination is made as to whether a portion of the aerodrome cells are or would be replaced with the plurality of aircraft cells. Each numeric value of the aerodrome cells that are or would be replaced is counted to determine a replacement count associated therewith and that is entered into the separate entry in the index count array for that numeric value. One or more potential aircraft wingtip strikes are detected based on the replacement counts.

20 Claims, 9 Drawing Sheets

(56) References Cited

U.S. PATENT DOCUMENTS

| | | | |
|---|---|---|---|
| 2012/0200433 | A1 | 8/2012 | Glover et al. |
| 2013/0096814 | A1 | 4/2013 | Louis et al. |
| 2013/0321176 | A1 | 12/2013 | Vasek et al. |

OTHER PUBLICATIONS

Jeppesen; Jeppesen Introduces Web Based Runway Analysis Service to Optimize Operators Takeoff Performance; [Retrieved from Internet http://ww1.jeppesen.com/company/newsroom/articles.jsp?newsURL=news/newsroom/2011/Runway_Analysis_NR.jsp].
Honeywell; KGP 560 & KGP 860 General Aviation Enhanced Ground Proximity Warning System; Bendix/King Pilot's Guide; Copyright © 2000, 2001, 2003-2005 Honeywell International Inc. 006-18254-0001 Revision Oct. 7, 2005.
Aircraft Performance Group; Atlas by Aircraft Performance Group.

* cited by examiner

PASSIVE AIRCRAFT WINGTIP STRIKE DETECTION SYSTEM AND METHOD

CROSS-REFERENCE TO RELATED APPLICATION

This application claims the benefit of U.S. Provisional Patent Application No. 61/989,341, filed May 6, 2014, which is incorporated herein by reference.

TECHNICAL FIELD

The present invention generally relates to aircraft wingtip strike prevention, and more particularly relates to systems and methods for passively detecting aircraft wingtip strikes.

BACKGROUND

Aircraft pilots often maneuver an aircraft while on the ground. This may happen during ground operations such as when the aircraft is taxiing, being maneuvered to or from a hangar, or to or from a terminal.

Obstacles on the ground, such as structures, other vehicles and other obstacles, may lie in the path of the aircraft. These obstacles can be detected by the pilot via line of sight. However, in many instances, due to the dimensions of the aircraft (e.g., large wing sweep angles, distance from cockpit to wingtip) and the pilot's limited field of view, it can be difficult to monitor extremes of the aircraft during ground operations. As a result, the operator may fail to detect obstacles that are located in "blind spots" in proximity to the aircraft. In many cases, the pilot may not detect an obstacle until it is too late to take corrective action. To alleviate this, many aircraft include active sensors or cameras or to sense potential or imminent strikes.

Collisions with an obstacle can not only damage the aircraft, but can also put the aircraft out of service and result in flight cancellations. The costs associated with the repair and grounding of an aircraft are significant. As such, the timely detection and avoidance of obstacles that lie in the ground path of a vehicle is an important issue that needs to be addressed.

Currently, there is no economical system available to protect aircraft from wingtip strikes. As aircraft increase in size, the probability and cost of a strike incident increases. Therefore, there is a need for a system that can be retro-fitted onto aircraft with a minimum of effort, and that does not rely on active sensors or flight crew personnel. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a method for passively detecting aircraft wingtip strikes includes generating a digital base map of at least a portion of an aerodrome that includes one or more specific wingtip strike threats, where the digital base map is represented by a plurality of aerodrome cells. A numeric value is assigned to each of the aerodrome cells. Each assigned numeric value is representative of the specific wingtip strike threat associated with that aerodrome cell. An index count array that has a separate entry for each numeric value is generated. A digital aircraft structure representative of an aircraft is generated. The digital aircraft structure is represented by a plurality of aircraft cells. A determination is made as to whether a portion of the aerodrome cells are or would be replaced with the plurality of aircraft cells, and each numeric value of the aerodrome cells that are or would be replaced is counted to determine a replacement count associated therewith. The replacement count associated with each numeric value is entered into the separate entry in the index count array for that numeric value, and one or more potential aircraft wingtip strikes is detected based on the replacement counts in the index count array. The digital aircraft structure comprises a plurality of protective envelopes around the aircraft.

In another embodiment, a passive aircraft wingtip strike detection system includes an aerodrome database and a processor. The aerodrome database has aerodrome data stored therein that is representative of specific wingtip strike threats. The processor is in operable communication with the aerodrome database. The processor is configured to selectively retrieve aerodrome data from the aerodrome database and, upon retrieval thereof, is configured to: generate a digital base map of at least a portion of an aerodrome that includes one or more specific wingtip strike threats, the digital base map represented by a plurality of aerodrome cells, assign a numeric value to each of the aerodrome cells, the numeric value assigned to each aerodrome cell representative of the specific wingtip strike threat associated with that aerodrome cell, generate an index count array, the index count array having a separate entry for each numeric value, generate a digital aircraft structure representative of an aircraft, the digital aircraft structure represented by a plurality of aircraft cells, determine whether a portion of the aerodrome cells are or would be replaced with the plurality of aircraft cells, count each numeric value of the aerodrome cells that are or would be replaced to determine a replacement count associated therewith, enter the replacement count associated with each numeric value into the separate entry in the index count array for that numeric value, and detect one or more potential aircraft wingtip strikes based on the replacement counts in the index count array. The digital aircraft structure comprises a plurality of protective envelopes around the aircraft.

Furthermore, other desirable features and characteristics of the passive strike detection system and method will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
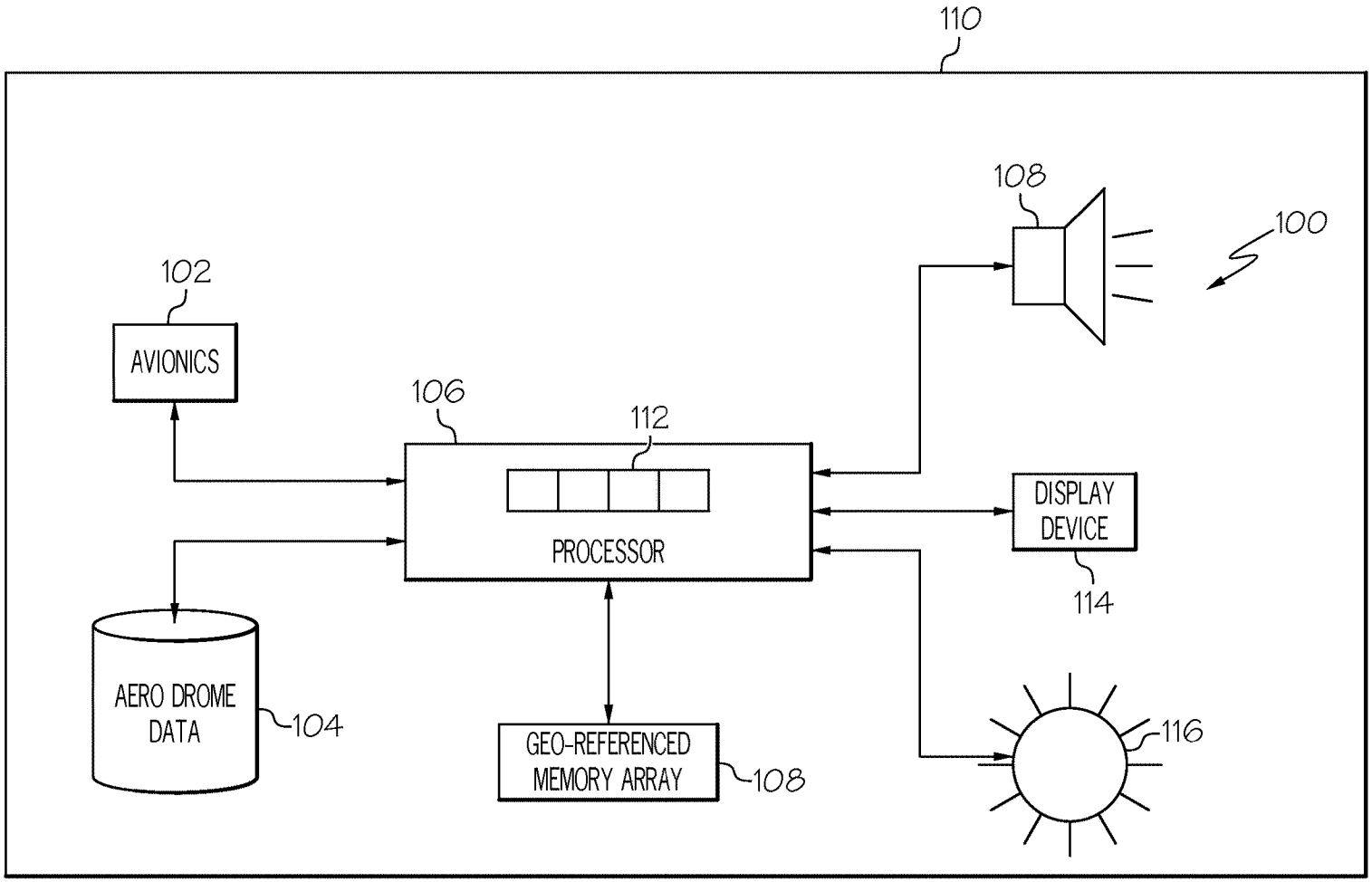
FIG. 1 depicts a functional block diagram of an embodiment of a passive wingtip strike detection system.

Referring first to FIG. 1, a functional block diagram of one embodiment of a passive wingtip strike detection system 100 is depicted. The depicted system 100 includes an avionics data source 102, an aerodrome database 104, and a processor 106, all disposed within an aircraft 110. The avionics data source 102 may be variously implemented, and may include any one of numerous known devices, subsystems, and sensors. Regardless of its implementation, the avionics data source 102 is configured to sense and supply aircraft data that are at least representative of aircraft position, aircraft speed, and aircraft orientation, for both itself and other aircraft, as well as position, speed, and orientation of other vehicles, to the processor 106. In this regard, the avionics data source 102 may include, for example, an ADS-B transceiver.

The aerodrome database 104 has aerodrome data stored therein. The aerodrome data are representative of various specific wingtip strike threats and various other aerodrome structures. As used herein, the term "specific wingtip strike threat" encompasses both the presence and absence of solid physical structure that an aircraft wing may strike. In particular, a specific wingtip strike encompasses an open region that includes no solid physical structure, as well as various physical structures present at an aerodrome. Such physical structures may include, for example, terminal buildings, non-terminal buildings (e.g., fences, posts, light poles, signage), and moving objects (e.g., baggage carts, other aircraft). The various other aerodrome structures may include, for example, runways and taxiways. The wingtip strike threats and other aerodrome structures may be variously represented. But in the depicted embodiment these entities are represented in the form of individual sections (or segments), lines, points, and circles, depending on the objects. Preferably, though not necessarily, the aerodrome data are stored in a relatively simple compressed format that can be easily and rapidly decompressed by the processor 106.

The processor 106 is in operable communication with the aerodrome database 104 and is configured to selectively retrieve aerodrome data therefrom. As may be appreciated, the aerodrome data that the processor 106 selectively retrieves are representative of the aerodrome at which the aircraft is presently located. As may also be appreciated, for those embodiments in which the aerodrome data are stored in a compressed format, the processor 106 generates the digital base map by decompressing the retrieved aerodrome data. The processor 106, upon retrieval of the aerodrome data, generates a digital base map of at least a portion of the aerodrome, which may include one or more terminal buildings, non-terminal buildings, and moving objects. In the depicted embodiment, the digital base map is copied to a geo-referenced memory array 108.

The processor 106 is also in operable communication with the avionics data source 102 and is coupled to receive the aircraft data therefrom. The processor 106 is configured, upon receipt of these data, to determine current aircraft position, speed, and orientation, and, at least in some embodiments, to predict future aircraft positions, speeds, and orientations. The processor 106 is additionally configured, upon receipt of the aircraft data, to generate a digital aircraft structure representative of the aircraft 110 and dispose the digital aircraft structure onto the digital base map. As will be described further below, the digital aircraft structure that the processor 106 generates may include one or more protective envelopes around the aircraft.

Figure 2:
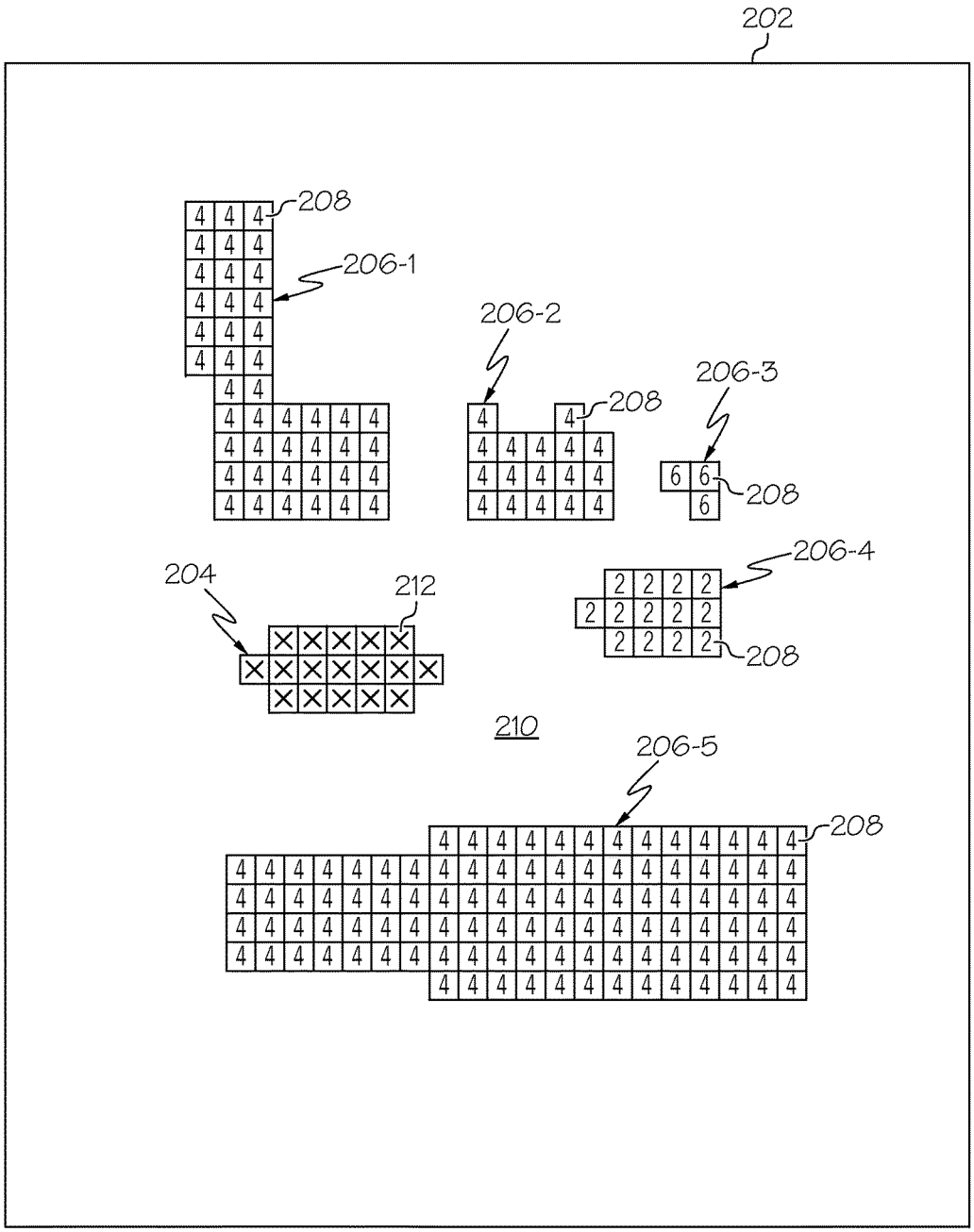
FIG. 2 depicts a simplified representation of a digital base map with a digital aircraft structure disposed thereon.

Referring now to FIG. 2, a simplified representation of a digital base map 202 with a digital aircraft structure 204 disposed thereon is depicted. The depicted digital base map 202 includes a plurality of specific wingtip strike threats 206. As previously noted, the term "specific wingtip strike threats" encompasses open regions, which include no solid physical structures, as well as various physical structures. As may be readily apparent, the depicted digital base map 202 includes five physical structures 206-1 through 206-5 disposed within an open region 210.

As FIG. 2 also depicts, the digital base map 202 and the digital aircraft structure 204 are each represented by a plurality of cells. In particular, the digital base map 202 that is generated is represented by a plurality of aerodrome cells 208, and the digital aircraft structure 204 that is generated is represented by a plurality of aircraft cells 212. It is noted that for clarity, each aerodrome cell 208 and each aircraft cell 212 are not illustrated with an associated reference numeral. Moreover, for ease of distinction, the aircraft cells 212 are illustrated with an "X" therein.

The processor 106, in addition to generating the digital base map 202 with an overlain digital aircraft structure 204, is configured to assign a numeric value to each of the aerodrome cells 208 and to generate an index count array 112 (see FIG. 1) that has a separate entry for each numeric value. The numeric value that the processor 106 assigns to each aerodrome cell 208 is representative of the specific wingtip strike threat associated with that aerodrome cell 208. It will be appreciated that the numeric values used may be varied, but in the depicted embodiment a zero (0) is assigned to each aerodrome cell 208 associated with an open space 210, and a non-zero numeric value is assigned to each aerodrome cell 208 associated with a physical structure 206-1 through 206-5. The same non-zero numeric value could be assigned to all aerodrome cells 208 associated with a physical structure, but in the depicted embodiment a different non-zero numeric value for different types of physical structures. For example, aerodrome cells 208 associated with non-terminal buildings (i.e., 206-4) are assigned a numeric value of two (2), aerodrome cells 208 associated with terminal buildings (i.e., 206-1, 206-2, 206-5) are assigned a numeric value of four (4), and aerodrome cells 208 associated with moving objects (i.e., 206-3) are assigned a numeric value of six (6).

Referring back to FIG. 1, it is seen that the index count array 112 comprises a plurality of entries. In particular, it includes at least a separate entry for each numeric value that is assignable to an aerodrome cell 208. As already noted, the assignable numeric values may vary. In addition, the number of assignable numeric values may vary, depending upon the different types of physical structures that are being categorized. In the depicted embodiment, three different types of physical structures are categorized, and thus the index count array 112 includes four separate entries. It will be appreciated that the index count array 112 could include more or less than this number of entries, but as a minimum will include two separate entries. The purpose and functionality of the index count array 112 and its associated entries will be described further below.

Referring once again to FIG. 2, it was previously noted that the digital aircraft structure 204 that the processor 106 generates includes one or more protective envelopes around the aircraft. It should be noted that in most (though not all) embodiments the digital aircraft structure 204 that the processor 106 generates will include more than one protective envelope. The purpose for including multiple protective envelopes, and examples of multiple protective envelope usage, will be described further below.

Regardless of the number of protective envelope(s), each may be, for example, a simple circle (or other geometric shape) that surrounds the aircraft. If implemented as a circle, the radius of the circle is preferably set to cover the entire aircraft, and may additionally include a buffer or error budget, as needed or desired. As an example, if the aircraft has a 40 meter half wingspan, the envelope could be set to 45 meters, allowing for a 5 meter buffer on each side of the wing. In some embodiments, the size of the envelope(s) may vary based on detected aircraft speed. Moreover, the envelope(s) is(are) applied at not only the current aircraft position, but is(are) "walked" along the predicted future aircraft positions, as described above. It should be noted that the predicted future positions preferably include pilot reaction time and stopping time.

The processor 106 is configured, based on the retrieved aerodrome data and on the current and future aircraft positions, speeds and orientations, to implement a passive wingtip strike threat detection process. This detection process, which will now be described in more detail, is based on the content of the index count array 112, and more specifically the content of each entry in the index count array 112. This is because the content of each entry in the index count array 112 varies based on the number of aerodrome cells 208 of a specific numeric value that are replaced by an aircraft cell 212.

Figure 3:
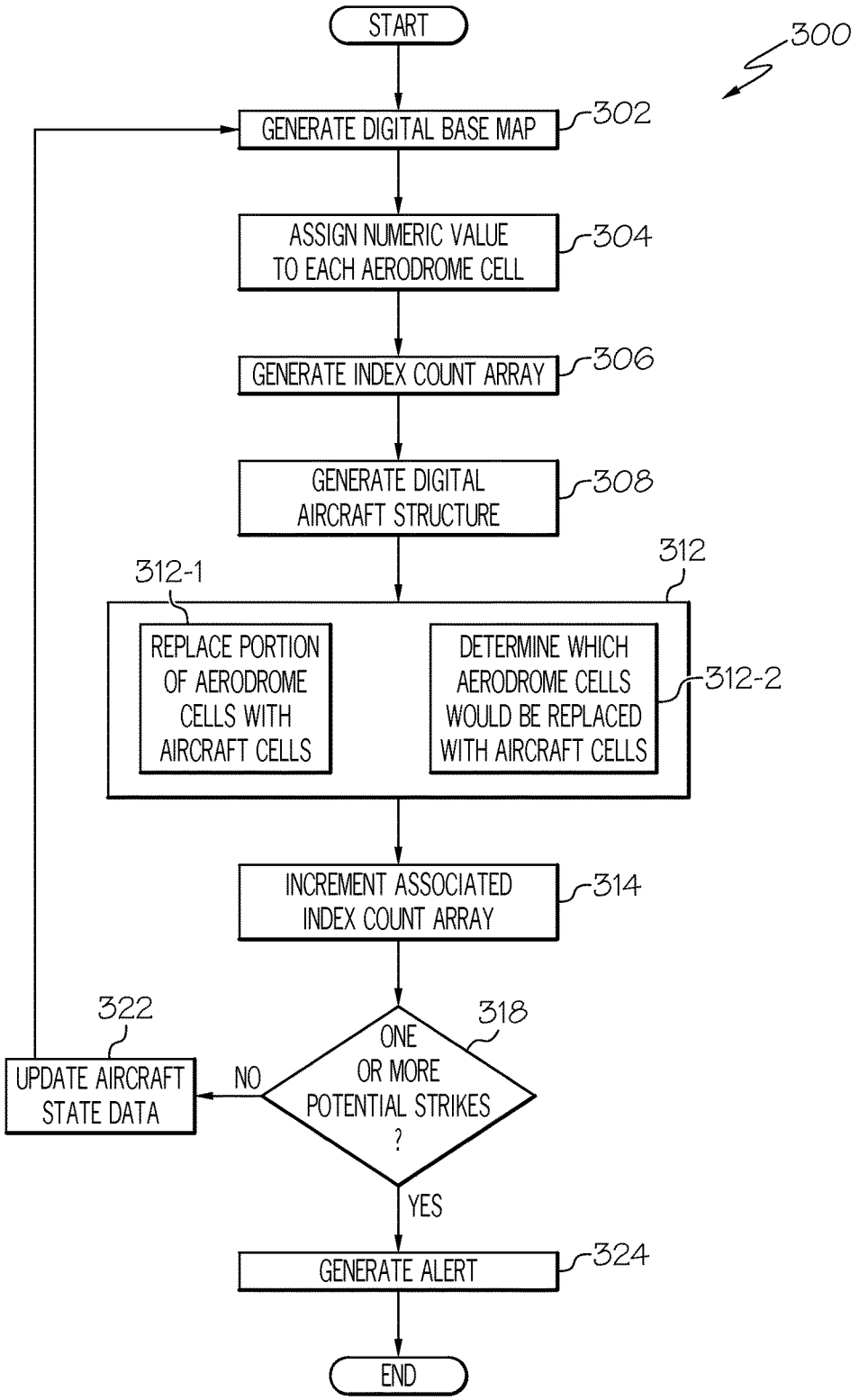
FIG. 3 depicts, in flowchart form, an embodiment of a detection process that is implemented by the system of FIG. 1.

Reference should now be made to FIG. 3, which depicts, in flowchart form, an embodiment of the detection process 300 that is implemented by the processor 106. The process 300 begins when the processor 106 retrieves appropriate aerodrome data from the aerodrome database 104 and generates a digital base map 202 of at least a portion of an aerodrome that includes one or more specific wingtip strike threats 206 (302). A numeric value is assigned to each of the aerodrome cells 208 (304) and the index count array 112 is generated (306). As previously noted, the assigned numeric values are representative of the specific wingtip strike threat associated with that aerodrome cell 208.

The digital aircraft structure 204, which is represented by a plurality of aircraft cells 212, is also generated (308), and a determination is made as to whether a portion of the aerodrome cells 208 are or would be replaced with the plurality of aircraft cells 212 (312). In one embodiment, the process 300 is implemented such that a portion of the aerodrome cells 208 are replaced with the plurality of aircraft cells 212 (312-1). In another embodiment, the process 300 is implemented such that the processor 106 determines which aerodrome cells 208 would be replaced with the plurality of aircraft cells 212 (312-1), but does not actually replace any aerodrome cells 208.

After the determination, each numeric value of the aerodrome cells 208 that are or would be replaced has its associated index count array entry incremented (314). More specifically, each numeric value of the aerodrome cells 208 that are or would be replaced is counted to determine an associated replacement count, and the replacement count associated with each numeric value is then entered into the separate entry in the index count array for that numeric value. A determination is then made whether one or more potential aircraft wingtip strikes is detected based on the replacement counts in the index count array 112 (318). If no strikes are detected, the aircraft state data are updated (322) and a portion of the process repeats (302-318). If a strike is detected, an alert is generated (324).

Figure 4:
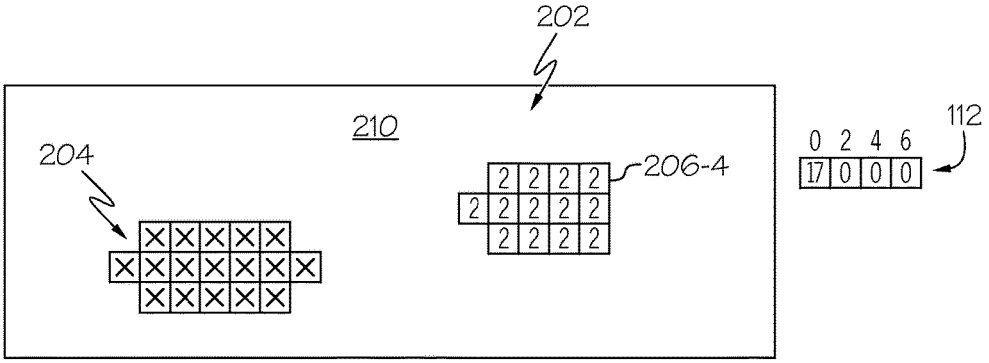
FIGS. 4-6 depict a portion of the digital base map with a digital aircraft structure disposed thereon that is depicted in FIG. 2, to more clearly illustrate the process of FIG. 3.
Figure 5:
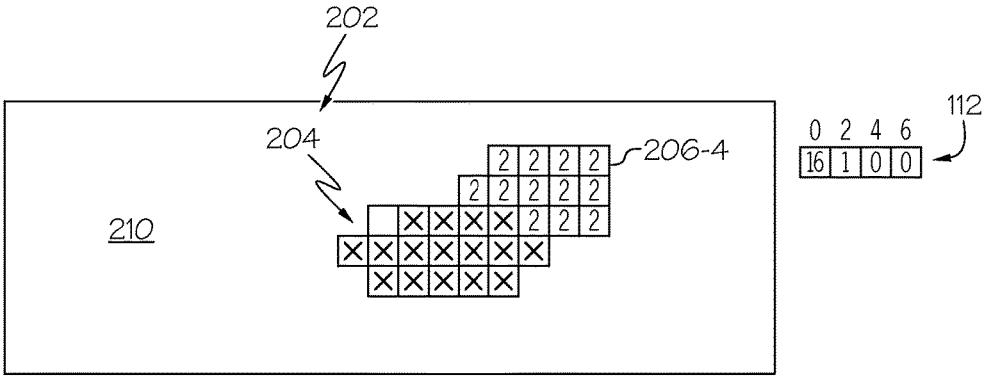
Figure 6:
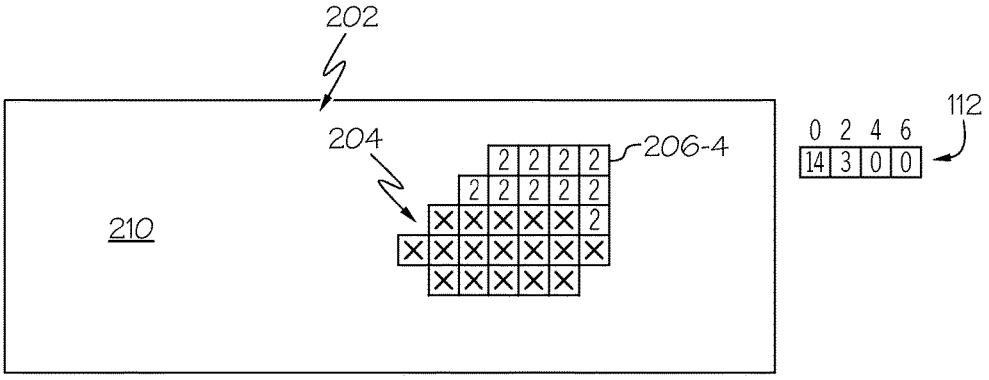

To more clearly illustrate the above-described process, reference should be made to FIGS. 4-6, which depict only a portion of the digital base map 202 with the digital aircraft structure 204 disposed thereon. For clarity and ease of depiction and description, the digital base map 202 that is depicted includes only one physical structure, in this case a non-terminal building 206-4 that comprises 13 aerodrome cells 208, and that is surrounded by open space 210. Moreover, the digital aircraft structure 204 is depicted as comprising 17 aircraft cells 212.

At the point in time illustrated in FIG. 4, all 17 aircraft cells 212 have replaced only open space aerodrome cells 208 (numeric value of 0), and none of the other types of aerodrome cells 208 (numeric values of 2, 4, and 6). Thus, the replacement counts associated with each numeric value, and the concomitant entries in the index count array 112 are: 0:17, 2:0, 4:0, 6:0. Based on the replacement counts in the index count array, no potential aircraft wingtip strikes are detected.

As the aircraft moves along its actual or predicted path, the entries in the index count array will remain the same as depicted in FIG. 4, until the point in time depicted in FIG. 5. At that point, 16 of the aircraft cells 212 have replaced open space aerodrome cells 208, and 1 of the aircraft cells 212 has replaced one of the non-terminal building aerodrome cells 208. Thus, the replacement counts associated with each numeric value, and the concomitant entries in the index count array are: 0:16, 2:1, 4:0, 6:0. Based on the replacement counts in the index count array, a potential aircraft wingtip strike is detected. The process 300 could stop at this point, but if it continues on to the point in time depicted in FIG. 6, 14 of the aircraft cells 212 have replaced open space aerodrome cells 208, and 3 of the aircraft cells 212 have replaced one of the non-terminal building aerodrome cells 208. Thus, the replacement counts associated with each numeric value, and the concomitant entries in the index count array are: 0:14, 2:3, 4:0, 6:0.

It is noted that if there is only one type of threat being protected against, the process 300 may stop as soon as a potential aircraft wingtip strike is detected. If multiple threats are being protected against, then the entire digital aircraft structure 204 can be rendered onto the digital working map 202. Moreover, whether the processor 106 detects one or multiple threats, it will generate one or more alert signals. Returning to FIG. 1, the alert signals are supplied at least to an aural alert device 108, such as a speaker, but may additionally or instead be supplied to a visual alert device 116, such as a lamp. In some embodiments, the processor 106 may also command a display device 114 to render images similar to those depicted in FIGS. 4-6.

It was noted above that the purpose for including multiple protective envelopes, and examples of multiple protective envelope usage, would be described. That description will now be provided. The main purpose for using multiple envelopes is so that the system 100 can respond to, and provide alerts for, different wing tip strike threats, and not just any and every threat. For example, in an embodiment that includes two protective envelopes, a first protective envelope may be sized and coded to respond to only non-terminal buildings, and a second protective envelope may be sized and coded to respond to both terminal buildings and non-terminal buildings. In other embodiments, a third protective envelope may be included and, if so, sized and coded to respond to moving obstacles. Some non-limiting examples of moving obstacles include other aircraft and ground vehicles.

Figure 7:
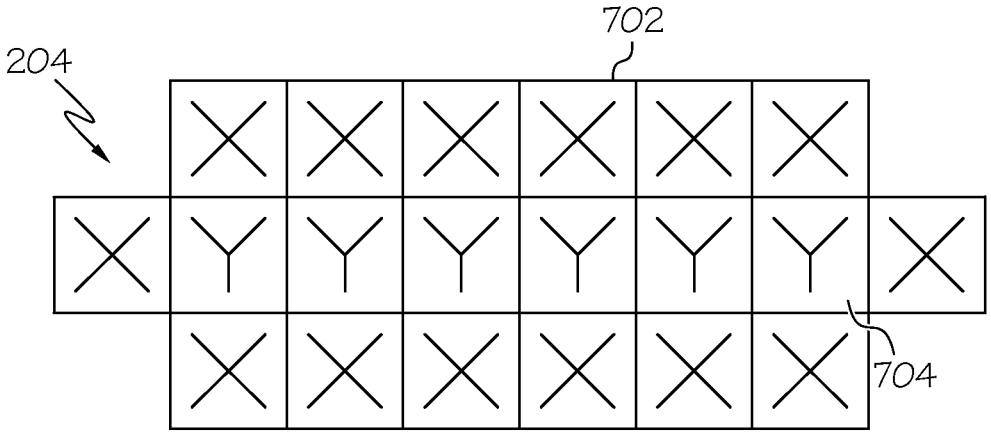
FIG. 7 depicts a simplified representation of a digital aircraft structure that is generated with two protective envelopes.

Referring now to FIG. 7, a simplified representation of a two protective envelope example is depicted. The depicted digital aircraft structure 204 includes a first protective envelope 702 (represented with X's) and a second protective envelope 704 (represented with Y's). Although the first envelope 702 is depicted as completely surrounding the second protective envelope 704, it will be appreciated that this merely exemplary and that the first protective envelope 702 may, in some embodiments, only partially surround the second protective envelope 704.

The first protective envelope 702 is coded to respond to only a first type of wingtip strike threat, and the second protective envelope 704 is coded to respond to the first type of wingtip strike threat and a second type of wingtip strike threat. For example, in one embodiment, the first protective envelope 702 is coded to respond only to non-terminal buildings, and the second protective envelope 704 is coded to respond to terminal and non-terminal buildings. The first protective envelope 702 being larger than the second envelope 704 allows the first protective envelope 702 to represent a slower reaction time and a lower braking force, as compared to that of the second protective envelope 704. The reason for this is that it is expected for aircraft to get relatively close to terminal buildings. Because of this, it is additionally expected that pilots will be more assertive in stopping the aircraft, so a more aggressive and faster response is anticipated. In one non-limiting example, the first protective envelope 702, which responds to non-terminal buildings, is sized and configured to represent a 5 second reaction time with ¼ g braking, and the second protective envelope 704, which responds to terminal buildings (and non-terminal buildings), is sized and configured to represent a 3 second reaction time with ⅓ g braking.

Figure 8:
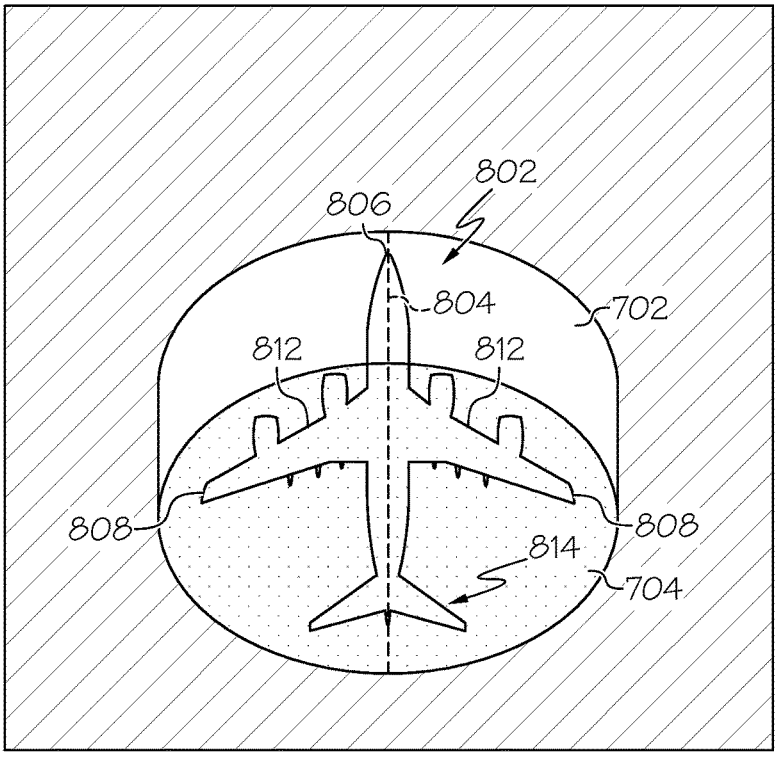
FIGS. 8-15 depict more detailed representations of digital aircraft structures that are generated with two protective envelopes.
Figure 9:
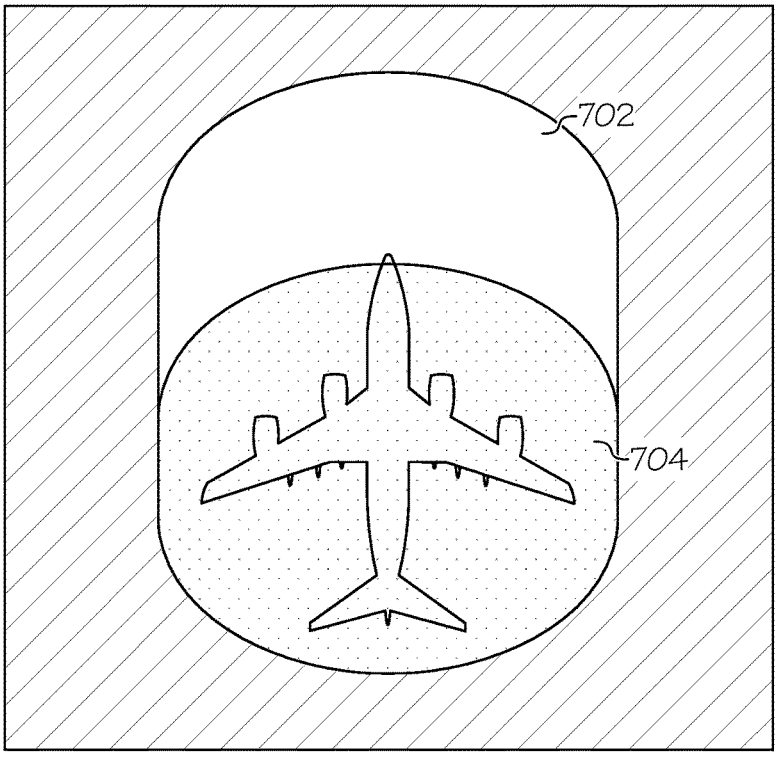
Figure 10:
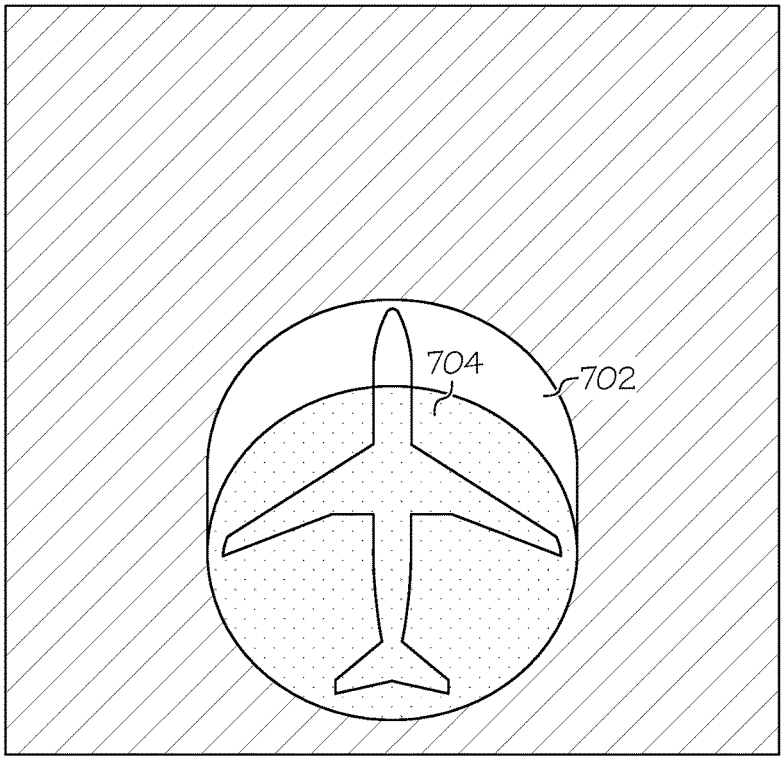
Figure 11:
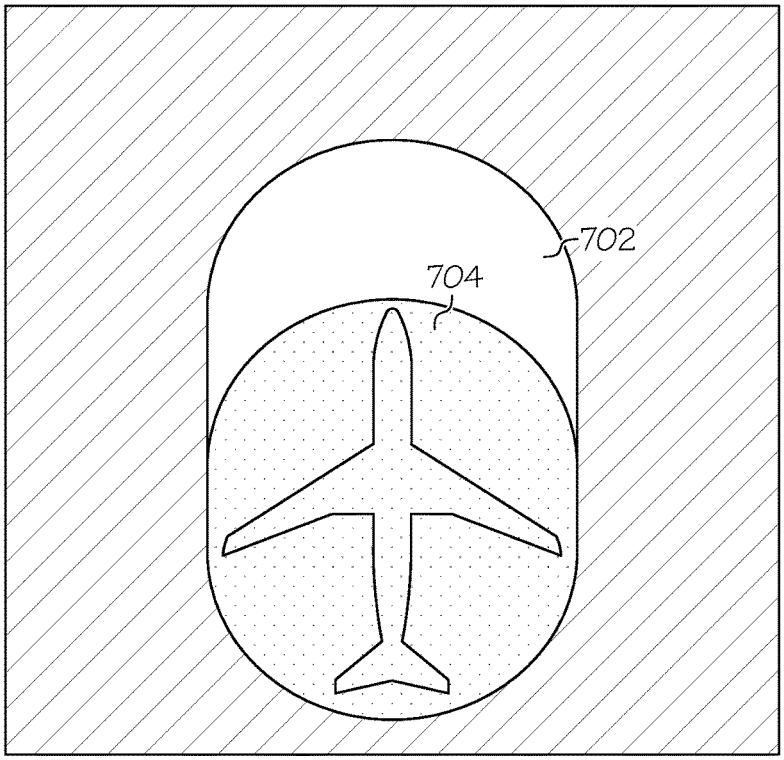
Figure 12:
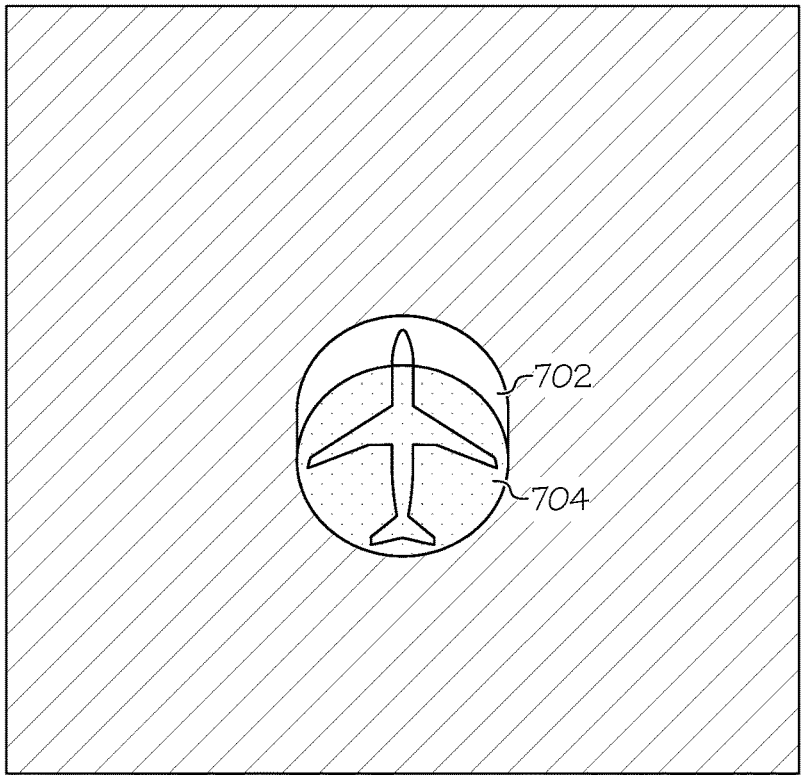
Figure 13:
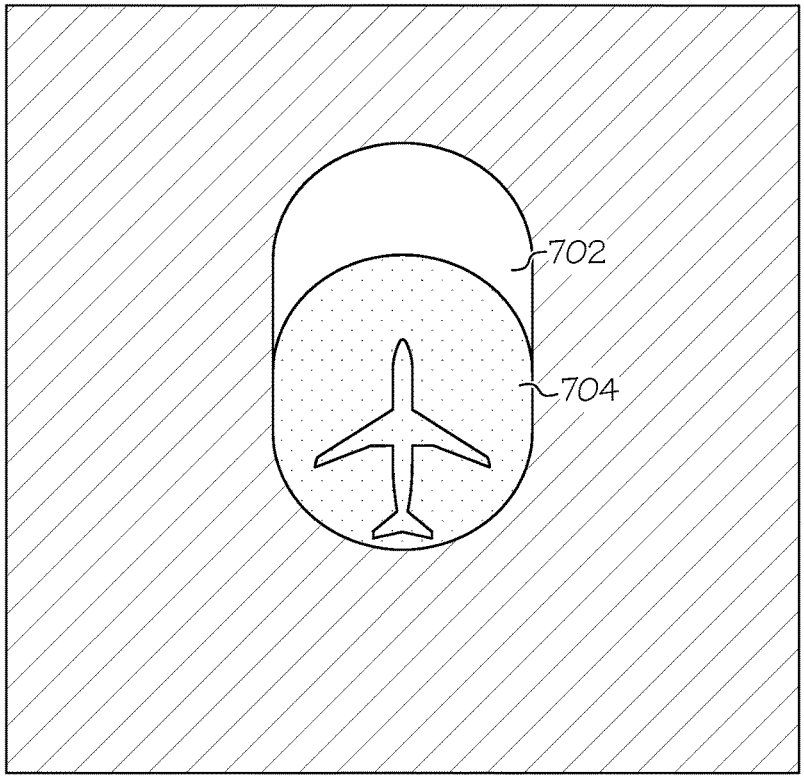
Figure 14:
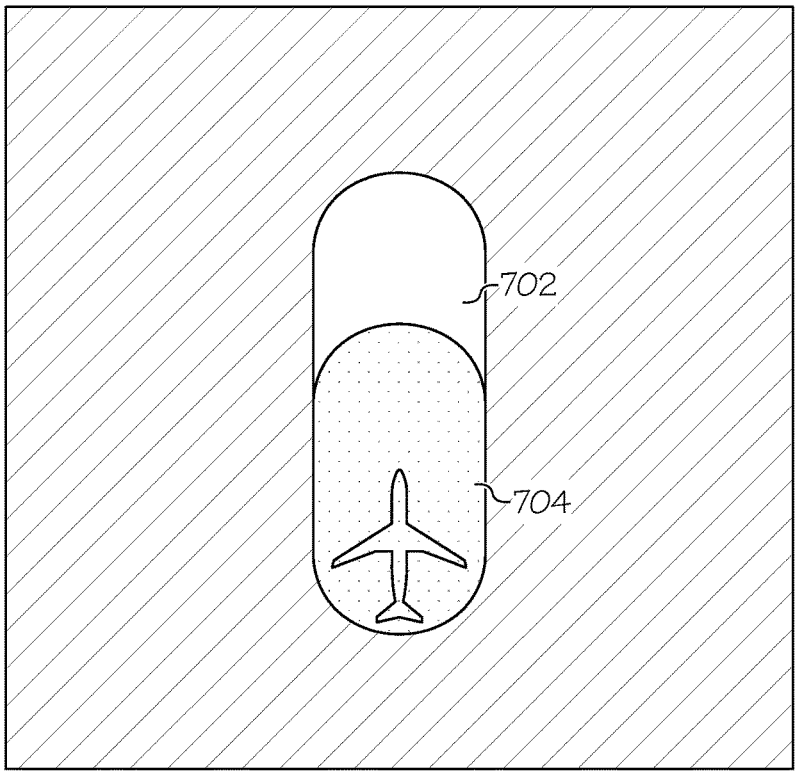

More detailed depictions of the protective envelopes 702, 704 for different types of aircraft at zero and non-zero speeds are depicted in FIGS. 8-14. In particular, FIGS. 8 and 9 depict example protective envelopes 702, 704 for an Airbus A380 aircraft at 0 knots and 10 knots, respectively, FIGS. 10 and 11 depict example protective envelopes 702, 704 for a Boeing 777 aircraft at 0 knots and 10 knots, respectively, and FIGS. 12, 13, and 14 depict example protective envelopes 702, 704 for a Boeing 737 aircraft at 0 knots, 10 knots, and 20 knots, respectively. It will be appreciated that the size and shapes of the protective envelopes 702, 704 used for these particular aircraft models may vary. It will additionally be appreciated that protective envelopes 702, 704 may be generated for numerous other aircraft models, not just the three that are mentioned and depicted herein.

Although, as just noted, the specific shape of the protective envelopes 702, 704 may vary, in the depicted embodiments the envelopes are implemented as an ellipse around the aircraft 802. The center of the ellipse is on the longitudinal axis 804 of the aircraft and is offset back from the nose 806 to optimize the coverage and reduce nuisance alerts. The lateral axis of the ellipse is set to cover the wingtips 808, and the longitudinal axis of the ellipse is set to provide coverage for the leading edge of the wings 812 and the empennage 814 of the aircraft. With this configuration, the nose 806 of the aircraft remains outside the second protective envelope 704 when the aircraft 802 is stopped (e.g., FIGS. 8, 10, and 12). Based on the current aircraft vector (sensed ground speed and heading), the protective envelopes 702, 704 are projected forward along this vector (e.g., FIGS. 9, 11, 13, and 14). The length of the projection is a function of the sensed ground speed, predetermined pilot reaction time(s), a predetermined braking coefficient, and a predetermined fixed offset. Although these predetermined values may vary, in one example embodiment associated with the Boeing 737 aircraft, the predetermined pilot reaction times are set to 3 seconds for the first protective envelope 702 and 5 seconds for the second protective envelope 704, the predetermined braking coefficient is set to ⅓ g for the first protective envelope 702 and ¼ g for the second protective envelope 704, and the predetermined fixed offsets are set to 0 meters for the first protective envelope 702 and 12 meters for the second protective envelope 704.

Figure 15:
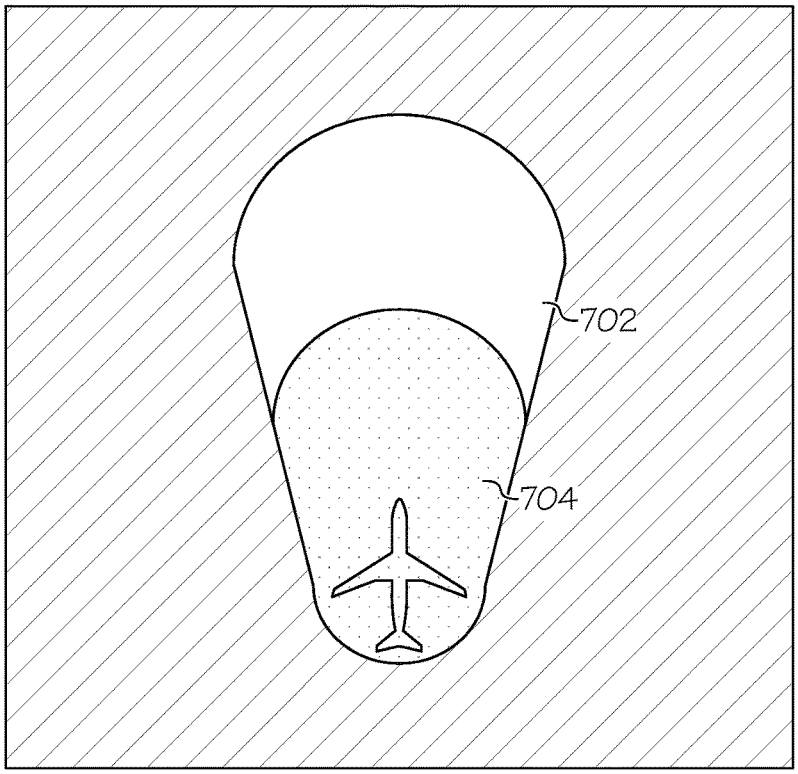

In addition to the basic projection of the protective envelopes 702, 704 along the aircraft vector, the system 100 may also be configured to implement an expansion factor such that one or both of the protective envelopes 702, 704 grows primarily wider as the distance from the current aircraft position increases. This expansion factor is independent for the two protective envelopes. An example of this expansion is depicted in FIG. 15. The depicted example is for a Boeing 737 aircraft traveling at 20 knots.

The system and method described herein provides a passive system that utilizes a database or map of airport/aerodrome structures that are potential collision hazards. In essence, a "graphical" threat detection approach is implemented that is relatively insensitive to the complexity of aerodrome geometry and eliminates the need for conventional wingtip strike sensors. Although sensors may still be needed in tight spaces such as gates, the system and method disclosed herein provides adequate protection from fixed obstacles.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, i.e., memory elements, digital signal processing elements, logic elements, or look-up tables, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, i.e., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC.

In this document, relational terms such as first and second, and the like may be used solely to distinguish one entity or action from another entity or action without necessarily requiring or implying any actual such relationship or order between such entities or actions. Numeric ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for passively detecting aircraft wingtip strikes, comprising the steps of:

in a processing system:

generating a digital base map of at least a portion of an aerodrome that includes one or more specific wingtip strike threats, the digital base map represented by a plurality of aerodrome cells;

assigning a numeric value to each of the aerodrome cells, the numeric value assigned to each aerodrome cell representative of the specific wingtip strike threat associated with that aerodrome cell;

generating an index count array, the index count array having a separate entry for each numeric value;

generating a digital aircraft structure representative of an aircraft, the digital aircraft structure represented by a plurality of aircraft cells;

determining whether a portion of the aerodrome cells are or would be replaced with the plurality of aircraft cells;

counting each numeric value of the aerodrome cells that are or would be replaced to determine a replacement count associated with each numeric value of the aerodrome cells that are or would be replaced;

entering the replacement count associated with each numeric value into the separate entry in the index count array for that numeric value;

detecting one or more potential aircraft wingtip strikes based on the replacement counts in the index count array; and selectively generating an alert based on the one or more potential aircraft wingtip strikes that are detected, wherein the digital aircraft structure comprises a plurality of protective envelopes around the aircraft.

2. The method of claim 1, wherein:

the plurality of protective envelopes comprises a first protective envelope and a second protective envelope;

the first protective envelope is coded to respond to a first type of wingtip strike threat; and the second protective envelope is coded to respond to the first type of wingtip strike threat and to a second type of wingtip threat.

3. The method of claim 2, wherein:

the first type of wingtip strike threat is a non-terminal building; and the second type of wingtip strike threat is a terminal building.

4. The method of claim 1, wherein each of the protective envelopes has a size, and wherein the method further comprises:

detecting aircraft speed; and varying the size of one or more of the protective envelopes based at least in part on the detected aircraft speed.

5. The method of claim 4, further comprising:

detecting aircraft heading;

determining a current aircraft vector based on the aircraft speed and aircraft heading; and varying the size of one or more of the protective envelopes based at least in part on the current aircraft vector.

6. The method of claim 4, wherein the step of varying the size of one or more of the protective envelopes is based additionally on a predetermined value representative of pilot reaction time, a predetermined braking coefficient, and a predetermined fixed offset associated with each of the protective envelopes.

7. The method of claim 5, wherein the step of varying the size comprises projecting one or more of the protective envelopes along the current aircraft vector.

8. The method of claim 4, wherein the step of varying the size comprises applying a predetermined expansion factor to progressively widen one or more of the protective envelopes.

9. The method of claim 1, further comprising:

selectively rendering, on a display device, the digital base map and the digital aircraft structure.

10. A passive aircraft wingtip strike detection system, comprising:

an aerodrome database having aerodrome data stored therein, the aerodrome data including data representative of specific wingtip strike threats; and a processor in operable communication with the aerodrome database, the processor configured to selectively retrieve aerodrome data from the aerodrome database and, upon retrieval thereof to:

generate a digital base map of at least a portion of an aerodrome that includes one or more specific wingtip strike threats, the digital base map represented by a plurality of aerodrome cells;

assign a numeric value to each of the aerodrome cells, the numeric value assigned to each aerodrome cell representative of the specific wingtip strike threat associated with that aerodrome cell;

generate an index count array, the index count array having a separate entry for each numeric value;

generate a digital aircraft structure representative of an aircraft, the digital aircraft structure represented by a plurality of aircraft cells;

determine whether a portion of the aerodrome cells are or would be replaced with the plurality of aircraft cells;

count each numeric value of the aerodrome cells that are or would be replaced to determine a replacement count associated with each numeric value of the aerodrome cells that are or would be replaced;

enter the replacement count associated with each numeric value into the separate entry in the index count array for that numeric value; and detect one or more potential aircraft wingtip strikes based on the replacement counts in the index count array, wherein the digital aircraft structure comprises a plurality of protective envelopes around the aircraft.

11. The system of claim 10, wherein:

the plurality of protective envelopes comprises a first protective envelope and a second protective envelope;

the first protective envelope is coded to respond to a first type of wingtip strike threat; and the second protective envelope is coded to respond to the first type of wingtip strike threat and to a second type of wingtip threat.

12. The system of claim 11, wherein:

the first type of wingtip strike threat is a non-terminal building; and the second type of wingtip strike threat is a terminal building.

13. The system of claim 10, wherein:

each of the one or more protective envelopes has a size;

the processor is adapted to receive data representative of aircraft speed; and the processor is further configured to vary the size of each of the one or more protective envelope based on the aircraft speed.

14. The system of claim 13, wherein:

the processor is adapted to receive aircraft heading data; and the processor is configured to determine a current aircraft vector based on the aircraft speed and aircraft heading, and vary the size of one or more of the protective envelopes based at least in part on the current aircraft vector.

15. The system of claim 13, wherein the processor is configured to vary the size of one or more of the protective envelopes based additionally on a predetermined value representative of pilot reaction time, a predetermined braking coefficient, and a predetermined fixed offset associated with each of the protective envelopes.

16. The system of claim 14, wherein the processor is further configured to project one or more of the protective envelopes along the current aircraft vector.

17. The system of claim 12, wherein the processor is further configured to apply a predetermined expansion factor to progressively widen one or more of the protective envelopes.

18. The system of claim 10, wherein:

the processor is further configured to selectively supply an alert signal based on the one or more potential aircraft wingtip strikes that are detected; and the system further comprises an alert device coupled to receive the alert signal and configured, in response thereto, to generate an alert.

19. The system of claim 10, further comprising:

a display device coupled to receive image rendering display commands and configured, upon receipt of the image rendering display commands, to render images, wherein the processor is further configured to selectively supply image rendering display commands to the display device that cause the display device to render images of the digital base map and the digital aircraft structure.

20. A method for passively detecting aircraft wingtip strikes, comprising the steps of:

in a processing system:

generating a digital base map of at least a portion of an aerodrome that includes one or more specific wingtip strike threats, the digital base map represented by a plurality of aerodrome cells;

assigning a numeric value to each of the aerodrome cells, the numeric value assigned to each aerodrome cell representative of the specific wingtip strike threat associated with that aerodrome cell;

generating an index count array, the index count array having a separate entry for each numeric value;

generating a digital aircraft structure representative of an aircraft, the digital aircraft structure represented by a plurality of aircraft cells;

determining whether a portion of the aerodrome cells are or would be replaced with the plurality of aircraft cells;

counting each numeric value of the aerodrome cells that are or would be replaced to determine a replacement count associated with each numeric value of the aerodrome cells that are or would be replaced;

entering the replacement count associated with each numeric value into the separate entry in the index count array for that numeric value;

detecting one or more potential aircraft wingtip strikes based on the replacement counts in the index count array, wherein:

the digital aircraft structure comprises a plurality of protective envelopes around the aircraft, the plurality of protective envelopes comprises a first protective envelope and a second protective envelope, the first protective envelope is coded to respond to a first type of wingtip strike threat, the second protective envelope is coded to respond to the first type of wingtip strike threat and to a second type of wingtip threat, each of the protective envelopes has a size, and the method further comprises detecting aircraft speed, and varying the size of one or more of the protective envelopes based at least in part on the detected aircraft speed.

* * * * *